US006768804B1

(12) United States Patent
Isvan

(10) Patent No.: US 6,768,804 B1
(45) Date of Patent: Jul. 27, 2004

(54) ADJUSTABLE MICROPHONE BOOM WITH ACOUSTIC VALVE

(75) Inventor: Osman K. Isvan, Aptos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 121 days.

(21) Appl. No.: 09/999,049

(22) Filed: Nov. 15, 2001

(51) Int. Cl.[7] ..... H04R 25/00

(52) U.S. Cl. ..... 381/376; 381/372; 381/375; 381/382; 181/20

(58) Field of Search ..... 381/355, 356, 381/357, 358, 359, 360, 361, 362, 363, 364, 365, 366, 376, 313, 338, 375, 382; 181/20, 22, 126, 128

(56) References Cited

U.S. PATENT DOCUMENTS 2,485,405 A * 10/1949 Olney et at. ..... 379/430
3,909,556 A * 9/1975 Johanson ..... 381/313
3,975,599 A * 8/1976 Johanson ..... 381/313

FOREIGN PATENT DOCUMENTS

WO WO99/39544 * 8/1999 ..... H04R/1/00

* cited by examiner

*Primary Examiner*—Curtis Kuntz
*Assistant Examiner*—Brian Ensey
(74) *Attorney, Agent, or Firm*—Peter Hsieh

(57) ABSTRACT

A sound sensing apparatus such as a communication headset uses a microphone and an acoustic valve controlled by a movable boom to operate in at least a compact and an extended-boom mode, with the valve variously coupling the microphone to different openings on the boom or the main body functioning as the acoustic sensing point.

50 Claims, 12 Drawing Sheets

ADJUSTABLE MICROPHONE BOOM WITH ACOUSTIC VALVE

TECHNICAL FIELD

This invention relates generally to sound sensing devices with microphone booms, and more particularly to headsets that utilize a movable boom and an acoustic valve to enable multiple operating modes with different boom lengths.

BACKGROUND

Communications headsets can be used in a diversity of applications, and are particularly effective for use with mobile communications devices such as cellular telephones. Some headsets have long booms which place the acoustic sensing point near the user's mouth, while other headsets have short booms or no booms at all. The term "acoustic sensing point" is used herein to refer to the point (or more generally, location) in space where a headset collects sound waves. In some telephone headsets, the microphone is located directly at the acoustic sensing point at the distal end of a boom. In others, the boom is a hollow tube, and the sound travels from the sound sensing point at the distal end of the boom to the microphone located near the proximal end of the boom. When a short boom or boomless headset is used, there is a large distance between the user's mouth and the acoustic sensing point of the headset. When such headsets are used in noisy environments, this typically leads to a lower than desirable signal-to-noise ratio in the transmit signals (i.e. ratio between the amount of signals associated with the desired acoustic source such as the user's mouth and those from background noise). However, because of the unobtrusive and stylish appearance and easy stowability of compact short boom or boomless headsets, users continue to demand these types of headsets in many applications.

As a compromise between the needs for compactness and style and for satisfactory transmit signal quality, communications headsets with foldable booms are available. Some of these headsets have a non-operational compact mode, with the boom folded on top of the body, that allows for stowability, and also an extended-boom mode in which the headset can operate with adequate transmit signal quality. Hence, a user can stow a foldable communications headset in the compact mode, and in the extended-boom mode the headset can be used for communication.

Conventional headsets with foldable booms do not offer different operating modes. When the compact mode is chosen, these headsets are inoperable. This is because, with conventional headsets, when the boom is folded to place the headset in the compact mode, the acoustic sensing point typically ends up behind the user's ear, where it is too far from the user's mouth to assure a sufficient transmit signal level and signal-to-noise ratio at normal speech levels.

Furthermore, national and international telecommunications standards have been established, and in some places legislated, that define acceptable Send Loudness Ratings (SLR) that a telephone device must provide in order to be compatible with the telephone network in their jurisdiction. At present, a telephone device with a handset or headset can meet such compatibility requirements only if the acoustic sensing point is located within a limited range of user-adjustable distances from the user's mouth, which means that telephone headsets with foldable booms having a large range of movement cannot operate in both in the folded-boom and the compact modes.

Accordingly, it is desirable to provide a communications headset that operates in multiple modes, including at least a compact mode and an extended-boom mode, with high signal-to-noise ratios in the various modes. Additionally, what is desired is a reliable mechanism that enables the headset to maintain a transmit signal level that is consistent with the speech level in different modes of operation.

SUMMARY OF THE INVENTION

The present invention overcomes the limitations of conventional adjustable communications headset design by allowing the selection among multiple locations to receive acoustic input in response to the position of an adjustable boom. In one embodiment, the boom is adjustable into various positions and, with each position, enables the acoustic coupling of the microphone with one of a plurality of openings on the boom or the main body, whereby only the acoustically coupled opening functions as the acoustic sensing point.

According to one aspect of the present invention, when the boom changes position, the locations of one or more openings on the boom relative to the desired acoustic source are also changed. The opening that can most favorably be used as the acoustic sensing point is acoustically coupled to the microphone. Hence, in a preferred embodiment of the present invention, the acoustic sensing point is located at the opening on the boom which is closest to the desired acoustic source given the boom's position. In another embodiment, the boom has a sliding or pivoting secondary segment that can extend the boom to move the acoustic sensing point even closer to the desired acoustic source.

According to another aspect of the present invention, the movement of an adjustable boom operates an acoustic valve that couples the microphone to the acoustic sensing point, which may be located at any one of a plurality of locations on the boom or the main body given the boom's position. The boom may rotate about a pivot or slide along an axis. In one embodiment that takes advantage of this aspect of the present invention, the boom can be positioned in at least a first and a second position, and the headset has at least a first and a second openings. When the boom is in the first position, the first opening is closer to the desired acoustic source than the second opening, and, accordingly, the valve couples the microphone to the first opening. Conversely, when the boom is in the second position, the second opening is closer to the desired acoustic source, and the valve couples the microphone to the second opening.

The movable boom also enables the implementation of control mechanisms in the communications headset to compensate for different levels of sound input in different operating modes based on the different positioning of the boom. In one embodiment, the headset can include a transmit controller for adjusting the transmit gain in the electrical signals in response to the boom's position. In another embodiment, the communications headset can adjust the sensitivity of the microphone to received acoustic signals by altering the total volume of all acoustic cavities to which the microphone is exposed to, again based on the boom's position. In yet another embodiment, the boom includes acoustic channels that are designed to have different levels of acoustic energy attenuation. A further advantage of this aspect of the present invention is that the background noise can be effectively masked if the overall transmission level of the communications headset is reduced when it is operating with a high signal-to-noise ratio.

Additional advantages of the invention will be set forth in part in the description which follows and in part will be apparent from the description or may be learned by practice of the invention. The objects and advantages of the invention will be realized and attained by means of the elements and combinations particularly pointed out in the appended claims and equivalents.

The figures depict preferred embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

A communications headset design utilizing an acoustic valve to improve the quality of sound transmission is described below. In the following description, for purposes of explanation, numerous specific details are set forth in order to provide a thorough understanding of the invention. The art of headset design and acoustic engineering are such that many different variations of the illustrated and described features of the invention are possible. Those skilled in the art will undoubtedly appreciate that the invention can be practiced without some specific details described below, and indeed will see that other variations and embodiments of the invention can be practiced while still satisfying the teachings of the invention.

Figure 1:
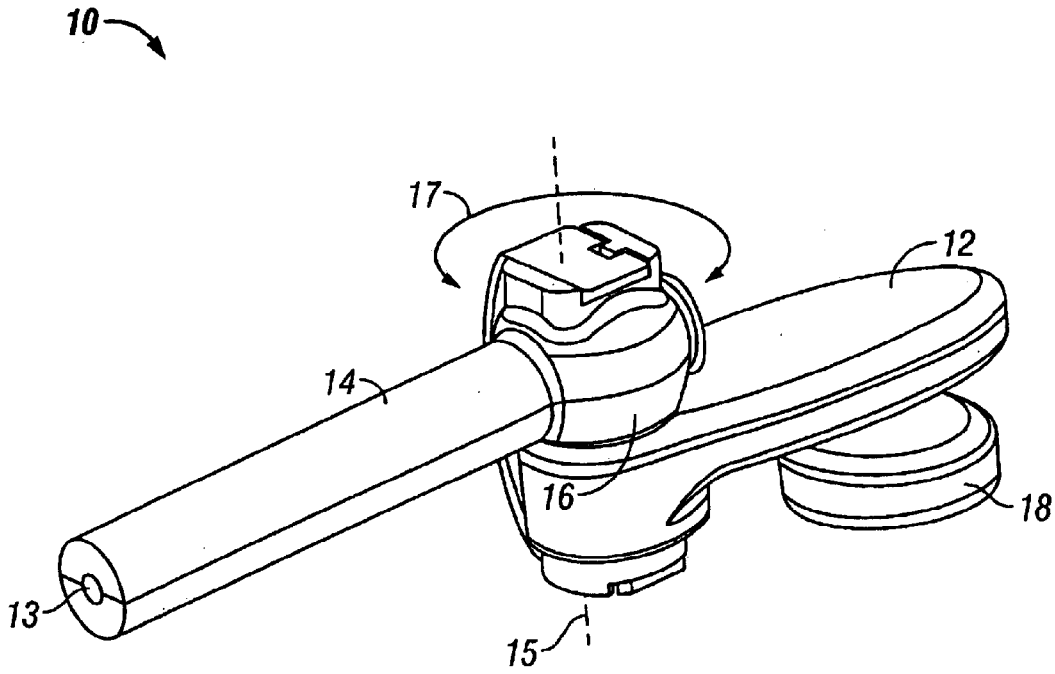
FIG. 1 is a perspective view of a foldable headset in accordance with the present invention, illustrating the foldable boom in an unfolded position.

Referring to FIG. 1, there is illustrated an embodiment of a communications headset 10 in accordance with the present invention. Headset 10 includes a main body 12 and an adjustable boom 14. The boom 14 is movably coupled to the main body 12 at a pivoting hinge 16, the structure of which will be further elaborated below. An axis 15 at the centerline of the hinge 16 passes through the main body 12 and the boom 14. Hinge 16 facilitates angular pivoting movement of boom 14 with respect to the main body 12 about the axis 15, as indicated by the arrow 17. This freedom to rotate enables the boom 14 to be positioned at a wide range of angles relative to the main body 12.

Figure 2A:
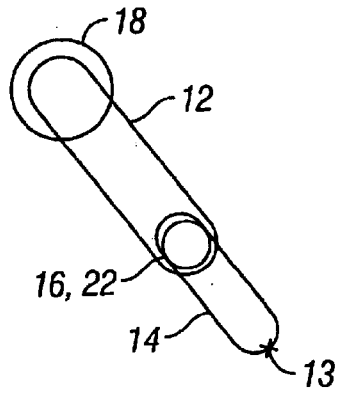
FIGS. 2(*a*), (*b*) and (*c*) are schematic drawings illustrating the arrangement of various elements of the headset of FIG. 1 when it is operating in different modes.
Figure 2B:
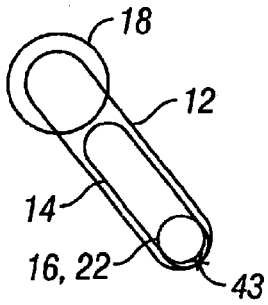
Figure 2C:
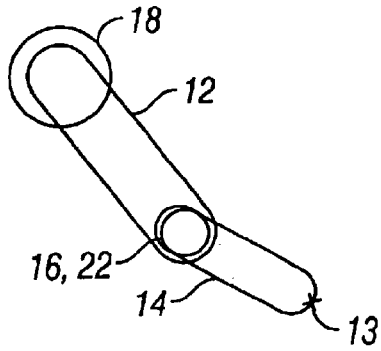

When the boom 14 is disposed at certain predetermined positions, an acoustic valve inside hinge 16 couples the microphone to a predetermined acoustic sensing point to enable adequate sound reception, as will be further discussed below. Hence, the communications headset 10 has multiple operating modes, each corresponding to a different position of the boom 14. At a minimum, these operating modes include an extended-boom mode in which the boom 14 is completely unfolded as shown schematically in FIG. 2(*a*), and a compact mode when the boom 14 is rotated to a position directly on top of the main body 12, as shown in FIG. 2(*b*), both figures corresponding to views of headset 10 from atop. Since the schematic illustrations in FIG. 2 are provided primarily to show the different arrangement of the relevant elements of headset 10 when it is operating in different modes, many details of the headset 10 are left out. Note, however, that the schematic diagrams include the location of the acoustic sensing point, which is shown to have moved from a first opening 13 on the boom 14 in FIG. 2(*a*) to a second opening 43 of the boom 14 in FIG. 2(*b*). This shifting of acoustic sensing point is an aspect of the present invention that will be discussed in detail below. In certain embodiments of the present invention, there may be intermediate positions of boom 14 that correspond to additional modes of operation. FIG. 2(*c*) illustrates one such intermediate boom position.

Referring back to FIG. 1, there is illustrated the extended-boom mode of operation. As noted above, boom 14 has an opening 13 at its distal end which functions as the acoustic sensing point in this operating mode. Hence, sound waves are received by the headset 10 through the opening 13. It will be readily apparent to those skilled in the art that, in other embodiments of the present invention, the acoustic sensing point is not restricted to be located on the boom, but can be located at various different locations as long as it serves as an entrance to an acoustic channel which subsequently conveys sound waves to a microphone. It will also be apparent to those skilled in the art that an acoustic sensing point may also refer to the location where a microphone is located. For example, in some communications headsets that include a boom but no acoustic valve, a microphone may be located at the distal end of the boom.

Also shown in FIG. 1 is an earpiece 18 near one end of the main body 12, with a generally pill-shaped configuration and preferably having a foam covering. The earpiece 18 is designed both as a mounting device that enables a user to wear the headset 10, and as an encasement for receiver elements (not explicitly shown in FIG. 1). It will be readily apparent to one skilled in the art that alternative configurations and sizes of earpiece may be provided with the headset 10. Depending on headset type, the earpiece 18 may be positioned inside the concha (i.e. the cavity surrounding the opening to the ear canal) of the user's ear (intra-concha headset), or it may rest against the pinna (supraaural headset), or else, it may surround the pinna (circumaural headset). FIG. 1 illustrates an intra-concha headset, by way of example.

Figure 3A:
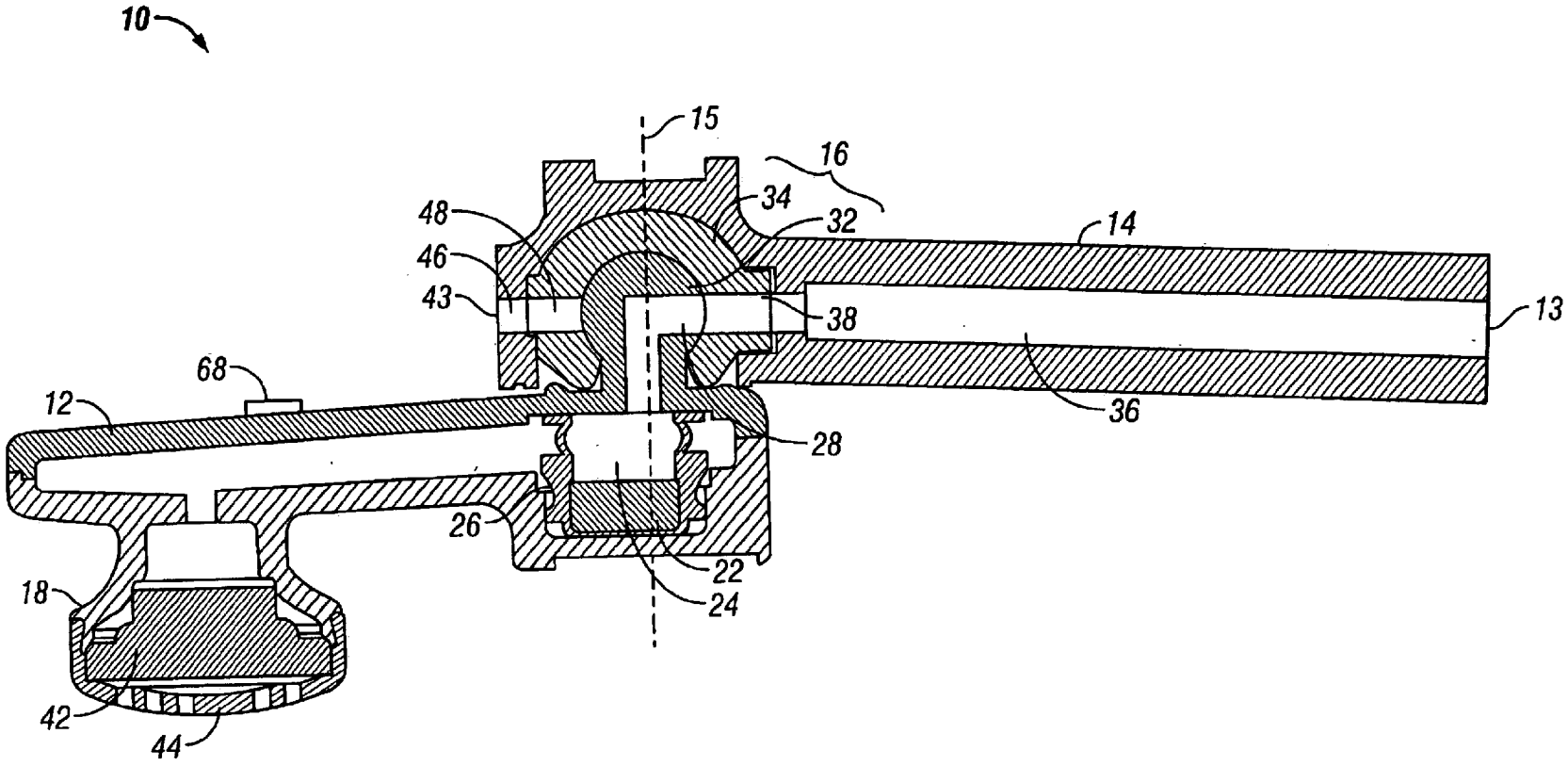
FIGS. 3(*a*) and (*b*) are cross-sectional views of the headset shown in FIG. 1 in the extended-boom and compact modes of operation, respectively.
Figure 3B:
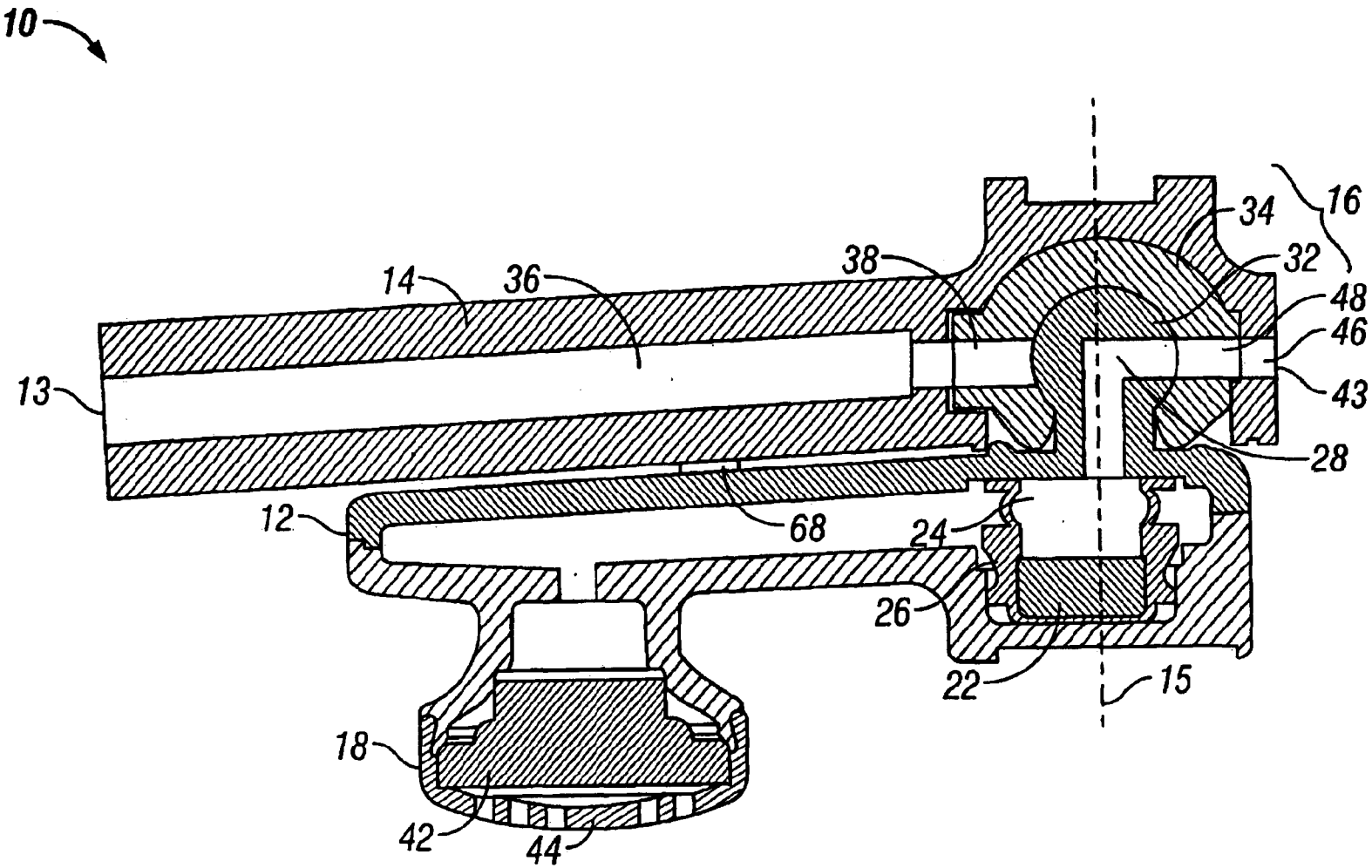

Referring now to FIG. 3(*a*), there is shown a cross-sectional view taken at the vertical mid-plane of the headset 10 of FIG. 1, with the headset in the same extended-boom mode of operation as shown in FIG. 1. The main body 12 is shown to encapsulate various electrical, acoustic, and mechanical components at its right end, including a microphone 22 and an adjacent acoustic cavity 24, both encased in a microphone boot 26. Above the acoustic cavity 24 is pivoting hinge 16, comprising a pivot ball 32 and a pivot socket 34, the latter adapted to rotate with respect to the former and about the axis 15. As the socket 34 rotates about ball 32, so does the boom 14. The boom 14 encases a sound tube 36 that terminates in an opening 13 that acts as the acoustic sensing point in the extended-boom mode of operation, as discussed above. It will be readily apparent to those skilled in the art that the pivoting hinge 16 may take other forms, such as a cylindrical pin-and-tube arrangement, as will be discussed below in connection with FIG. 4(*a*).

According to one aspect of the present invention, sound is collected at the acoustic sensing point from a desired acoustic source. The term "desired acoustic source," as used herein, refers to the location from where the user generates the sound signals to be transmitted, and is generally presumed to lie away from the main body 12 of the headset 10 in the general direction of the extended boom. Typically the desired acoustic source is the user's mouth, and the communications headset 10 is preferably designed and dimensioned to account for an approximate distance between the typical user's mouth and the ear, wherein the earpiece 18 will be disposed when the headset 10 is in use.

Sound from the desired acoustic source can be conducted through various acoustic channels to the microphone 22, the channel utilized depending on the mode the headset 10 is operating in, that is, in response to the position of the boom 14. In the embodiment depicted in FIGS. 1 and 3(*a*), the active acoustic channel is comprised of the sound tube 36, a short link tube 38 in the valve core, which in this case comprises pivot socket 34, and a bent link tube 28 in the valve cap, comprising pivot ball 32. These various channels 36, 38, and 28 together acoustically couple the acoustic sensing point at opening 13 to the microphone 22 via the acoustic cavity 24. On the other end of boom 14, there is shown in FIG. 3(*a*) a second, relatively short, sound tube 46. This second sound tube 46 terminates on one end in a second opening 43, and connects on the opposite end to a second link tube 48 in the pivot socket 34. These acoustic elements provide an alternative sound reception mechanism for headset 10 operating in a different mode, as discussed below.

Other details of the communications headset 10 are also illustrated in FIG. 3. For example, the earpiece 18 forms a cavity encapsulating a receiver transducer 42 and other electrical and mechanical components. The receiver transducer 42 receives electrical signals from a remote source (typically, whoever the user is talking to at the far end) and transforms them into audible signals. These signals subsequently reach the user's ear through the receiver grille 44, which may be covered with a foam protector (not explicitly shown).

Referring now to FIG. 3(*b*), there is shown a second cross-sectional view of the communications headset 10 of FIG. 1 again taken at the vertical mid-plane. The headset 10 is depicted here in the compact mode of operation, with the boom 14 rotated to rest directly on top of the main body 12, as schematically illustrated in FIG. 2(*b*). In this mode of operation, the acoustic valve 16 acoustically couples the microphone 22 to opening 43, which is now functioning as the acoustic sensing point. Thus, sound from the desired acoustic source is collected at the opening 43 and conducted to the microphone 22 through an alternative acoustic channel comprised of the short sound tube 46, the link tube 48 in pivot socket 34, the bent link tube 28 in pivot ball 32 and the acoustic cavity 24. The shifting of the active acoustic sensing point from opening 13 to opening 43 is facilitated by the inclusion of two link tubes 38, 48 in the pivot socket 34 on opposite sides of the pivot ball 32. Hence, when boom 14 is positioned as shown in FIGS. 1 and 3, the bent link tube 28 in the pivot ball 32 is acoustically coupled to the link tube 38. When the boom 14 is repositioned, as shown in FIG. 3(*b*), such that the headset 10 operates in the compact mode, the socket moves with the boom in such a way that the link tube 48 instead of tube 38 becomes acoustically coupled to the bent link tube 28, when the latter remains substantially fixed relative to the main body 12. This mechanism of constructing and/or activating an appropriate acoustic channel in response the boom's position enables the pivoting hinge 16 to function as an acoustic valve.

One small detail that is shown in FIGS. 3(*a*) and (*b*) (but not in FIG. 1) is the optional switch 68 on the main body 12. The switch 68 can be used to selectively engage various mechanisms to compensate for the disparity in the sound level at the acoustic sensing point due to the acoustic sensing point being located at different distances from the source when the headset is operating in different modes. These mechanisms will be discussed in detail below.

The ability to shift the acoustic sensing point to a more favorable location in response to a change in the position of the boom 14 is an aspect of the present invention that offers an advantage over conventional communications headsets with foldable booms. Although the conventional foldable headsets may fold to place the boom in a relatively compact arrangement, they do not change, as a result, the location of the acoustic sensing point relative to the boom. This means that the acoustic sensing point will be disposed at a considerable distance away from the desired acoustic source, typically the user's mouth, and close to the earpiece 18, rendering the headset practically inoperable. In the described embodiment of the present invention, the acoustic valve 16 enables the selection among multiple locations for the acoustic sensing point in response to the position of the boom 14, thus the acoustic sensing point can be located as close as possible to the desired acoustic source with both boom positions of the communications headset 10. This is advantageous because the closer the active acoustic sensing point is to the desired acoustic source (the user's mouth), the higher is the level of to the user's voice at the acoustic sensing point. Consequently, with the use of the acoustic valve, the highest possible ratio of voice level to ambient noise level is maintained in the microphone signal in both (folded and unfolded) boom positions.

Figure 4A:
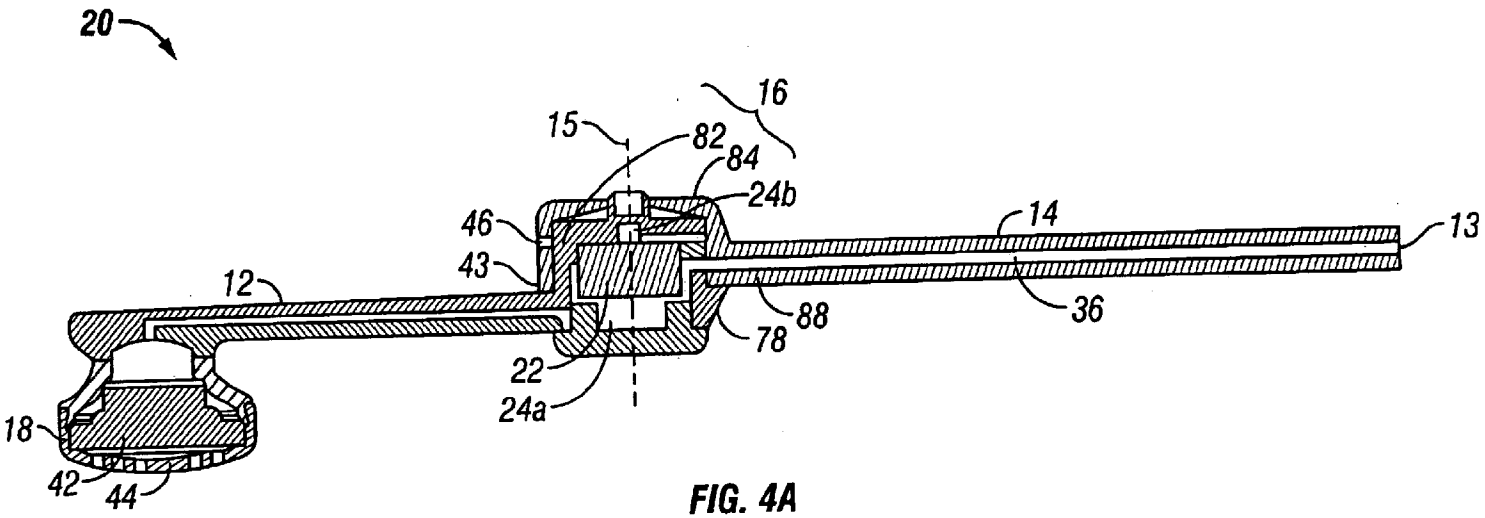
FIGS. 4(*a*) and (*b*) are cross-sectional views of an alternative embodiment of a foldable headset in accordance with the present invention, illustrating the extended-boom and compact modes of operation, respectively.
Figure 4B:
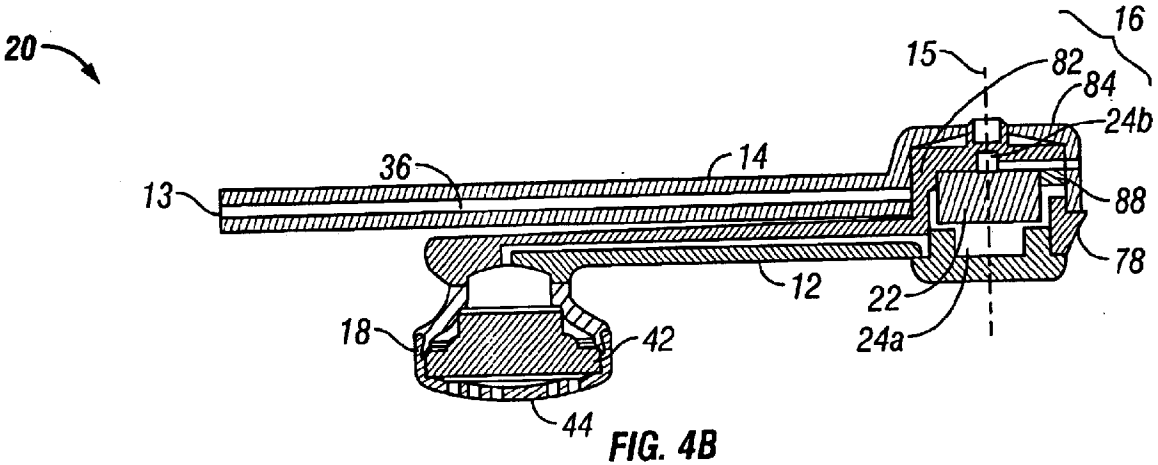

Referring now to FIG. 4, there is illustrated an alternative embodiment of the present invention that employs a pivoting hinge that functions as an acoustic valve. Like headset 10 depicted in FIGS. 1 and 3, the communication headset 20 can operate in multiple modes as illustrated in FIG. 2. Comparing FIG. 4 with FIG. 3 reveals that headset 20 shares many structural and functional features with headset 10, including the main body 12, pivoting boom 14, and earpiece 18, and all the components associated with these features. Headset 20, however, differs from headset 10 in the design of the hinge/acoustic valve 16, as discussed below.

The hinge 16 of headset 20 as shown in FIG. 4 consists of a cylindrical hub 82 and a cylindrical cap 84, functioning respectively as the valve core and the valve cap. The hub-and-cap arrangement allows the hinge to rotate about an axis 15 through its center. The boom 14 is adapted to rotate in sync with the cap 84, thus enabling the hinge 16 to function as an acoustic valve, in a similar way as does the acoustic valve 16 of headset 10 described above. Note that, although the ball-and-socket valve 16 depicted in FIG. 3 allows some extra degrees of freedom in addition to the rotation around axis 15, these additional degrees of freedom of rotation are not required for the operation of headset 10 in accordance with the present invention.

FIG. 4(*a*) is a cross-sectional view of the headset 20 in the extended-boom mode, taken at the vertical mid-plane. The hinge 16 is shown in FIG. 4(*a*) to enclose a microphone 22 as well as two acoustic cavities 24*a* and 24*b* on the two sides of the microphone 22. As apparent from FIG. 4(*a*), the microphone 22 is capable of receiving acoustic signals from both sides of its diaphragm. This is a characteristic of directional microphones, of which microphone 22 is one. This and other characteristics of directional microphone 22 facilitate the implementation of a mechanism to control the sensitivity of the microphone to input sound and therefore the audio transmission. Such mechanisms will be discussed in detail below.

As shown in FIG. 4(*a*), cavity 24*a* is connected to a bent link tube 78 which acoustically couples the microphone 22 from its lower side to the sound tube 36. Thus, the bent link tube 78 and the sound tube 36 form an active acoustic channel that conveys sound waves received at the opening 13 to the microphone 22 through the acoustic cavity 24*a*. On the other side of the microphone 22, the small cavity 24*b* is connected to another link tube 88 which is not used in the operating mode illustrated in FIG. 4(*a*). The smaller cavity 24*b*, however, becomes a sealed acoustic cavity coupled to the microphone 22 on the upper side, which, as will be discussed in detail below, affects the microphone's sensitivity. Now consider FIG. 4(*b*), which shows a cross-sectional view of the headset 20 operating in the compact mode. In the compact mode, the link tube 88 connects to the short sound tube 46 to form the active acoustic channel which couples the microphone 22 from the upper side to the opening 43. Hence, in this mode, the link tube 88 and the short sound tube 46 form the acoustic channel that passes through cavity 24*b*, which is no longer sealed.

Figure 5A:
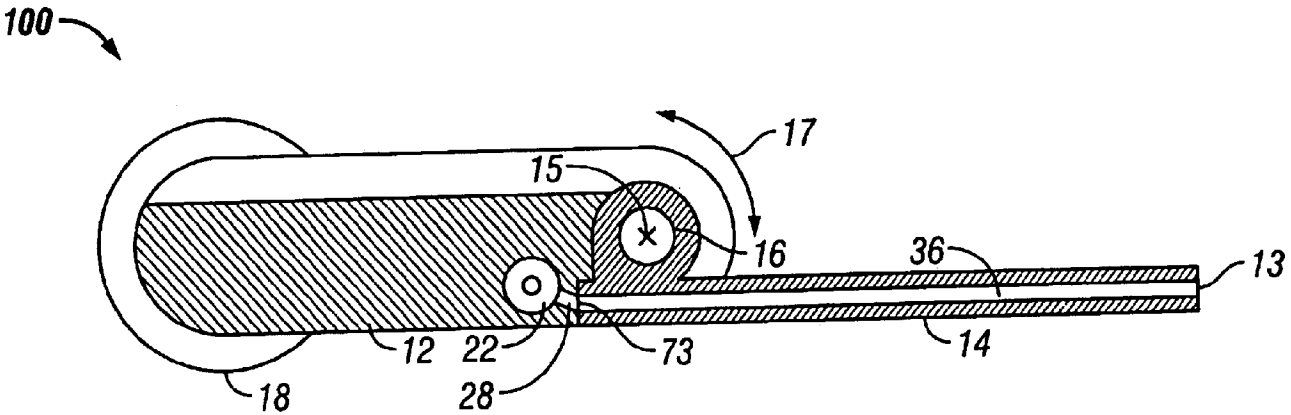
FIGS. 5(*a*) and (*b*) are cross-sectional views of yet another foldable headset in accordance with the present invention, illustrating the extended-boom and compact modes of operation, respectively.
Figure 5B:
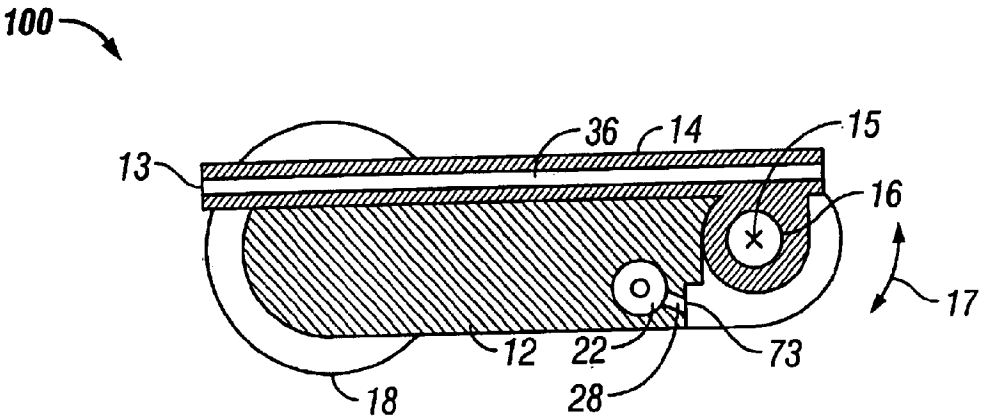
Figure 11A:
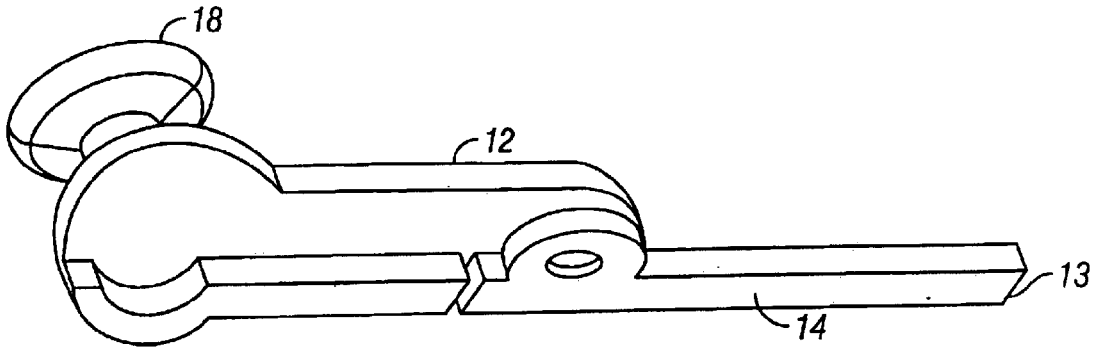
FIGS. 11(*a*) and (*b*) are perspective views of the headset shown in FIGS. 5(*a*) and (*b*).
Figure 11B:
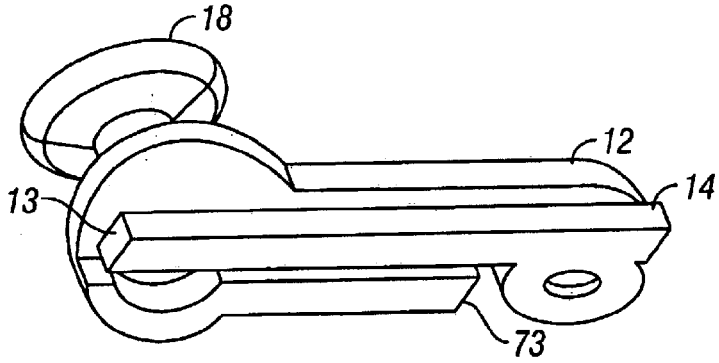

Referring now to FIG. 5, there is illustrated another embodiment of a communication headset 100 in accordance with the present invention. FIGS. 5(*a*) and (*b*) are cross-sectional views of headset 100 in the extended-boom and compact modes, respectively. The corresponding perspective views are illustrated in FIGS. 11(*a*) and (*b*). Despite the rather different appearance than the previously described headsets 10 and 20, many of the elements and features of headset 100 are analogous to those in headsets 10 and 20. For example, the main body 12 encloses a microphone 22 on one end and coupled to a earpiece 18 on the other end. Also, a boom 14 pivots about an axis 15 (perpendicular to the plane in which FIGS. 5(*a*) and (*b*) are drawn) of a hinge 16 disposed near the microphone 22.

Headset 100 operates under multiple modes based on the same concept (discussed above in connection with headsets 10 and 20) of shifting an acoustic sensing point to a location as close as possible to the desired acoustic source in response to the position of the boom. Hence, headset 100 operates also in the two modes schematically illustrated in FIGS. 2(*a*) and (*b*). One notable difference between headset 100 and headsets 10 and 20 is that the acoustic sensing point in the compact operating modes, as shown in FIG. 5(*b*), is located on the main body 12 rather than the boom 14. With this change, the headset 100 provides a very simple valve operation in order to select and/or shift the active acoustic channel. The link tube 28, together with the pivoting and aligning mechanisms of boom 14 and sound tube 36, forms the acoustic valve.

FIG. 5(*a*) shows the headset 100 in the extended-boom mode. In this mode, the boom 14 is swung outward with the distal end disposed close to the desired acoustic source, typically the user's mouth. The opening 13 at this distal end can therefore function as the acoustic sensing point. The other end of the boom 14 (and of sound tube 36 in it) is coupled with the opening 73 on the main body 12. This allows the acoustic coupling and alignment of the sound tube 36 with the short link tube 28, which together represent the acoustic channel for this mode of operation. In the other, compact, mode of operation depicted in FIG. 5(*b*), the boom 14 is swung back on top of the main body 12, leaving the opening 73 on the main body open to receive acoustic signals. Since this opening 73 is now closer to the desired sensing source, it is used as the acoustic sensing point, and the link tube 28, by itself, becomes the active acoustic channel.

Headset 100 helps illustrate various aspects of the present invention. First, as already mentioned, the acoustic valve can either refer to a relatively complex structure, as in headset 10 or 20, or it can refer to a relatively simple mechanism, as is the case with headset 100. Those skilled in the art will recognize that many other structures can be utilized to implement an acoustic valve. Another aspect of the invention is that an acoustic valve allows the selection of an active acoustic channel for each different mode of operation. This selection of acoustic channel is employed in each of the headsets 10, 20 and 100. Further, in each case, the acoustic channel is being formed as the boom 14 takes up certain positions. For example, in the extended-boom mode of operation of headset 10, as shown in FIG. 3(*a*), the link tubes 28 and 38 and sound tube 36 are aligned only with the boom 14 in the position shown to form the active acoustic channel (compare FIG. 3(*b*)). Likewise, for headset 100, the link tube 28 and sound tube 36 are aligned to form an active acoustic channel only in the extended-boom operating mode illustrated in FIG. 5(*b*). The selection of an active acoustic channel for each different mode of operation also enables the implementation of mechanisms for controlling the transmission loss, for example by putting acoustic energy attenuator elements inside selective sound tubes, or portions thereof, that forms the acoustic channels, as will be further discussed.

Figure 6A:
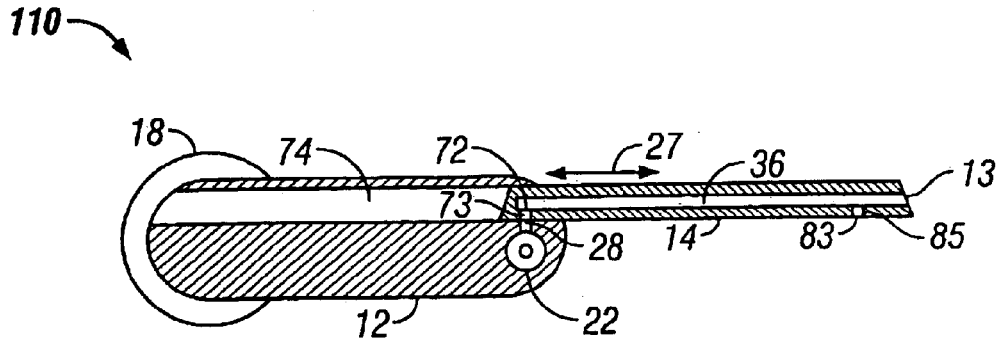
FIGS. 6(*a*) and (*b*) are cross-sectional views of a slidable headset in accordance with the present invention, illustrating the extended-boom and compact modes of operation, respectively.
Figure 6B:
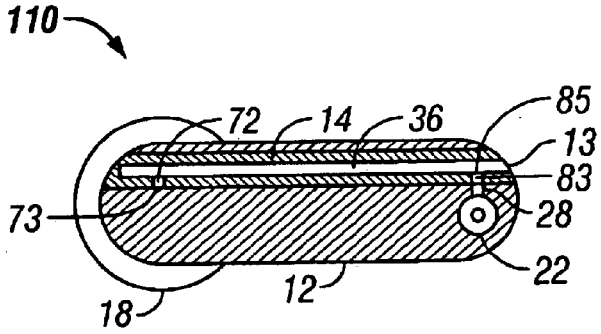

Referring now to FIG. 6, there is illustrated yet another embodiment of the communication headset 110 according to the present invention. Headset 110 has a similar external appearance as headset 100 described above. However, the boom 14 slides in and out of the main body 12 in a telescoping manner, as opposed to the pivoting mechanism described above. Accordingly, there is no hinge required in this embodiment. Rather, the slidable boom 14 itself acts as an acoustic valve by selectively activating an acoustic channel for each mode of operation, as discussed above. Also, even though the acoustic sensing point remains with the same opening 13, it is also being located at the closest possible point on the headset 110 in each of the two operating modes shown in FIGS. 6(*a*) and (*b*). Hence, headset 110 embodies at least these two aspects of the present invention.

Figure 12A:
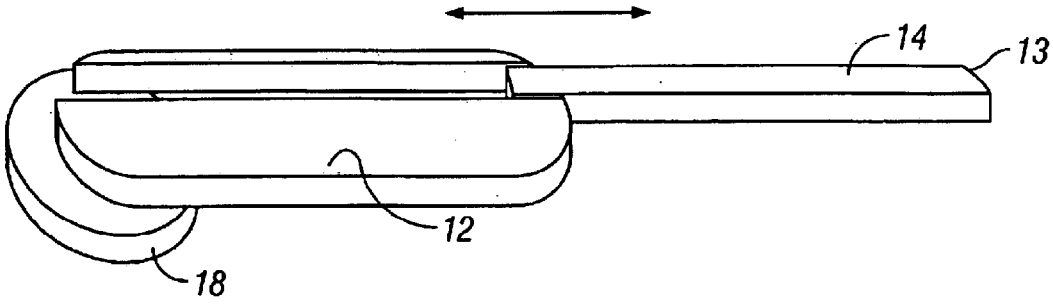
FIGS. 12(*a*) and (*b*) are perspective views of the headset shown in FIGS. 6(*a*) and (*b*).
Figure 12B:
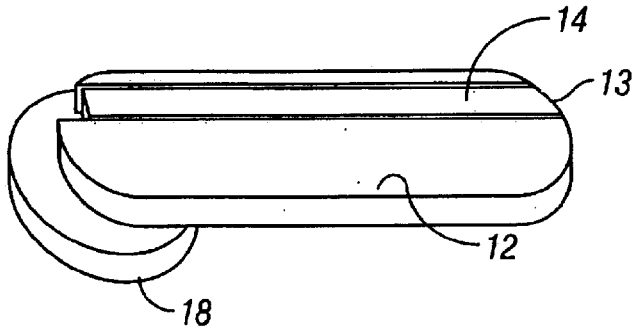

FIGS. 6(*a*) and (*b*) show the cross-sectional views of the headset 110 operating in the extended-boom and compact modes, respectively. The corresponding perspective views are illustrated in FIGS. 12(*a*) and (*b*). Referring to FIG. 6(*a*), the boom 14 has an opening 13 at its distal end which function as the acoustic sensing point, through which sound is received and conducted along at least a portion of the sound tube 36. Boom 14 also has two additional openings 73 and 83 acoustically coupled to the sound tube 36 via two short passages 72 and 85, respectively. The microphone 22 is coupled with the distal opening 13 through the first opening 73 when the boom 14 is extended, as illustrated in FIG. 6(*a*), but is coupled with opening 13 through the second opening 83 when the boom 14 is nestled inside main body 12, as illustrated in FIG. 6(*b*).

Figure 7A:
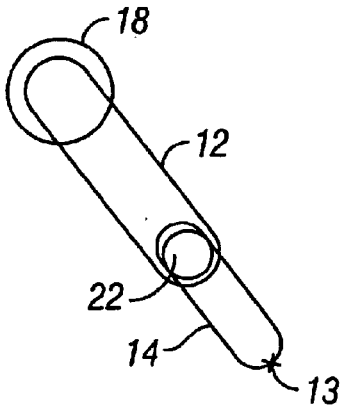
FIGS. 7(*a*), (*b*) and (*c*) are schematic drawings illustrating the arrangement of various elements of the headset of FIG. 6 when it is operating in different modes.
Figure 7B:
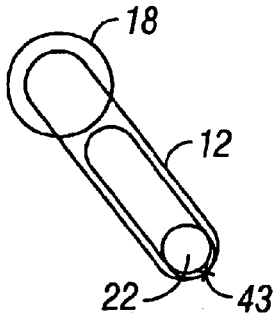
Figure 7C:
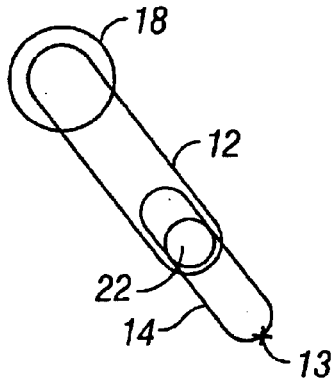

The various modes of operations of headset 110 are further illustrated in the schematic drawing illustrated in FIG. 7. Only the basic features of the headset 110 are included in these schematic drawings, which nevertheless clearly illustrate the different possible modes of operation. Comparing FIGS. 7(*a*) and (*b*) with FIGS. 2(*a*) and (*b*) demonstrates the conceptual similarities between the pivoting boom headset 10, 20, 100 and the sliding boom headset 110. FIG. 7(*c*), like FIG. 2(*c*), illustrates the additional possibility of the positioning of the boom 14. Those skilled in the art will recognize that the boom 14 can be positioned at an intermediate position as in FIG. 7(*c*) if intermediate openings between openings 73 and 83 are included in boom 14 at its interface with main body 12. Those skilled in the art will also recognize that other sliding boom designs may also take advantage of this aspect of the present invention.

Figure 8:
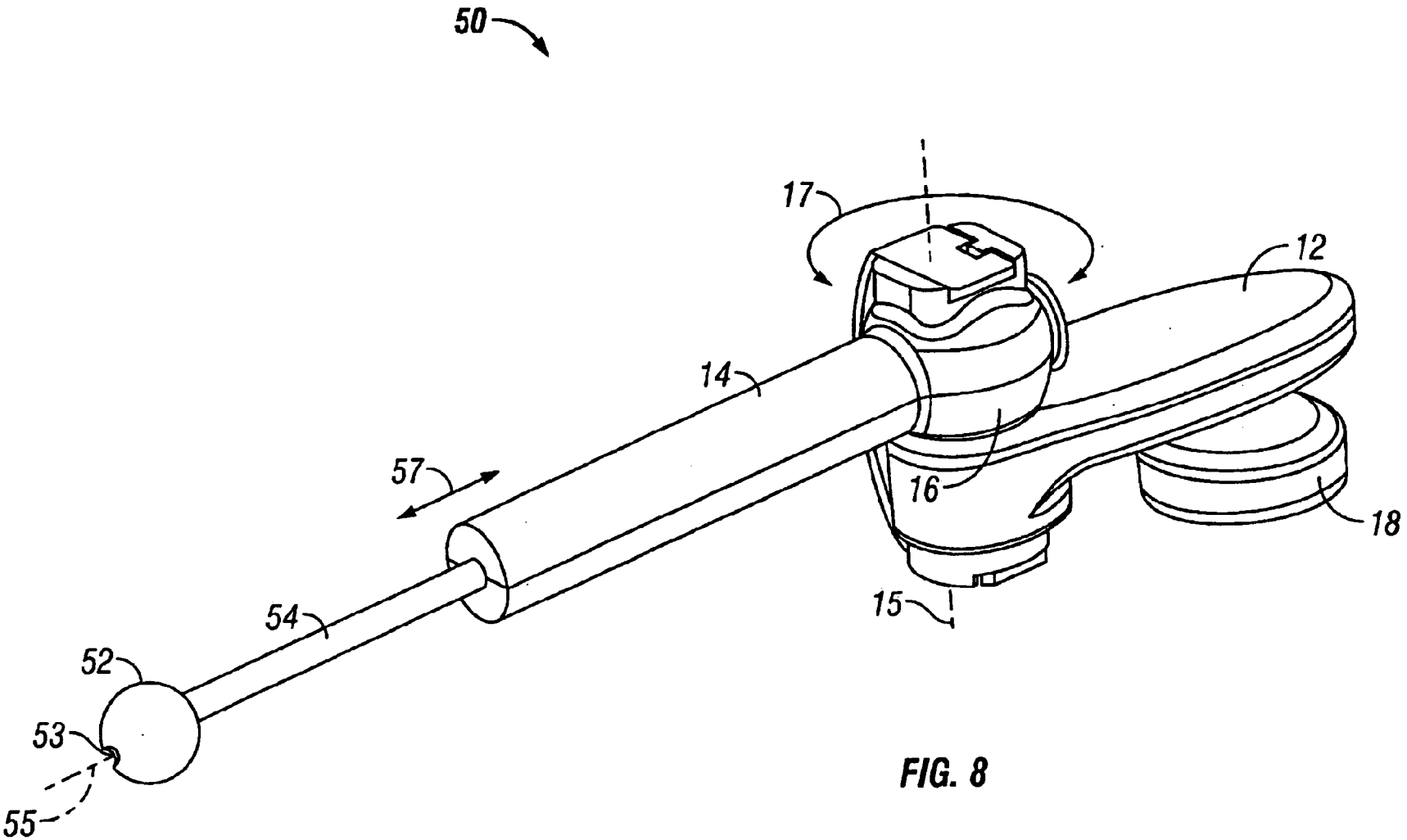
FIG. 8 is a perspective view of yet another headset in accordance with the present invention, illustrating a sliding inner boom in a fully-extended position.

Referring now to FIG. 8, there is illustrated a communications headset 50 according to yet another embodiment of the present invention. In this embodiment, a secondary, inner boom 54 is slidably engaged with the boom 14, enabling it to be telescopically extended or retracted with respect to boom 14 along the boom axis 55, as indicated by arrow 57. The positioning of the secondary boom 54 is facilitated by the provision of a knob 52. Analogous to opening 13 of the headset 10 illustrated in FIGS. 1 and 3(*a*), opening 53 at the end of the inner boom 54 functions as the acoustic sensing point. In the fully retracted position, as shown in FIG. 10*b*) and further discussed below, the secondary boom 54 is preferably nestled within boom 14.

Figure 9C:
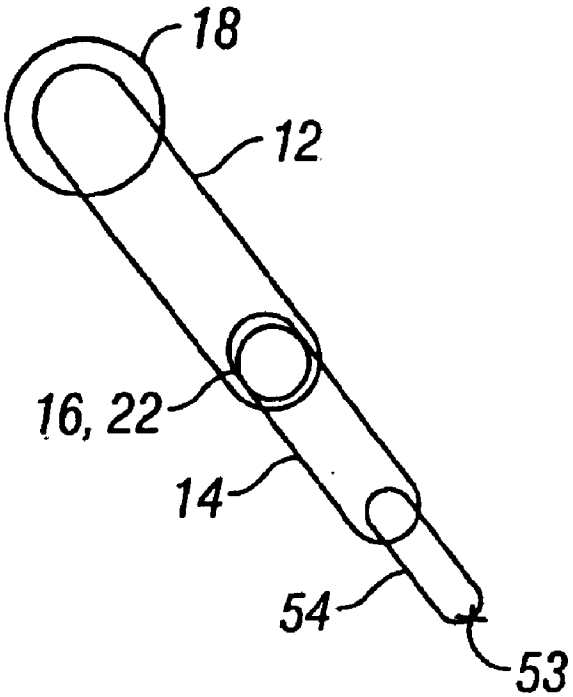
FIGS. 9(*a*), (*b*) and (*c*) are schematic drawings illustrating the arrangement of various elements of the headset of FIG. 8 when it is operating in different modes.
Figure 9B:
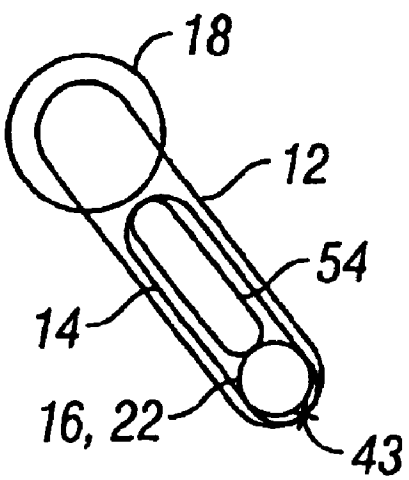
Figure 9A:
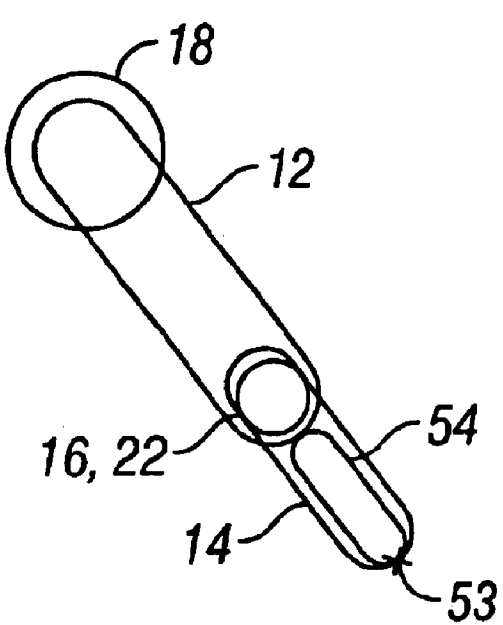

Headset 50 has at least three modes of operation, as illustrated schematically in FIG. 9. As in FIGS. 2 and 7, FIG. 9 shows only the elements of the communications headset 50 relevant for the illustration of the different modes of operation. The extended-boom and compact operating modes of headset 50, as illustrated in FIGS. 9(*a*) and 9(*b*) respectively, are analogous to the first two modes of operation of headset 10 shown in FIGS. 2(*a*) and (*b*). The only slight difference is that the acoustic sensing point in the extended-boom mode is located at an opening 53 at the end of a secondary boom 54, as discussed above, instead of an opening 13 (see FIG. 2(*a*)) at the end of boom 14. The third mode of operation, referred herein as the double-extended mode, is depicted in FIG. 9(*c*), as well as in FIGS. 8 and 10(*a*). This operating mode corresponds to having the inner boom 54 telescoping outward, effectively extending the length of boom 14, and placing the acoustic sensing point at opening 53 further away from the main body 12 and earpiece 18 and towards the desired acoustic source. Unlike the case with headset 110 depicted in FIG. 6, the amount of telescopic extension of the inner boom 54 beyond boom 14 is variable so that the user can adjust the location of the acoustic sensing point as appropriate for the situation.

Figure 10A:
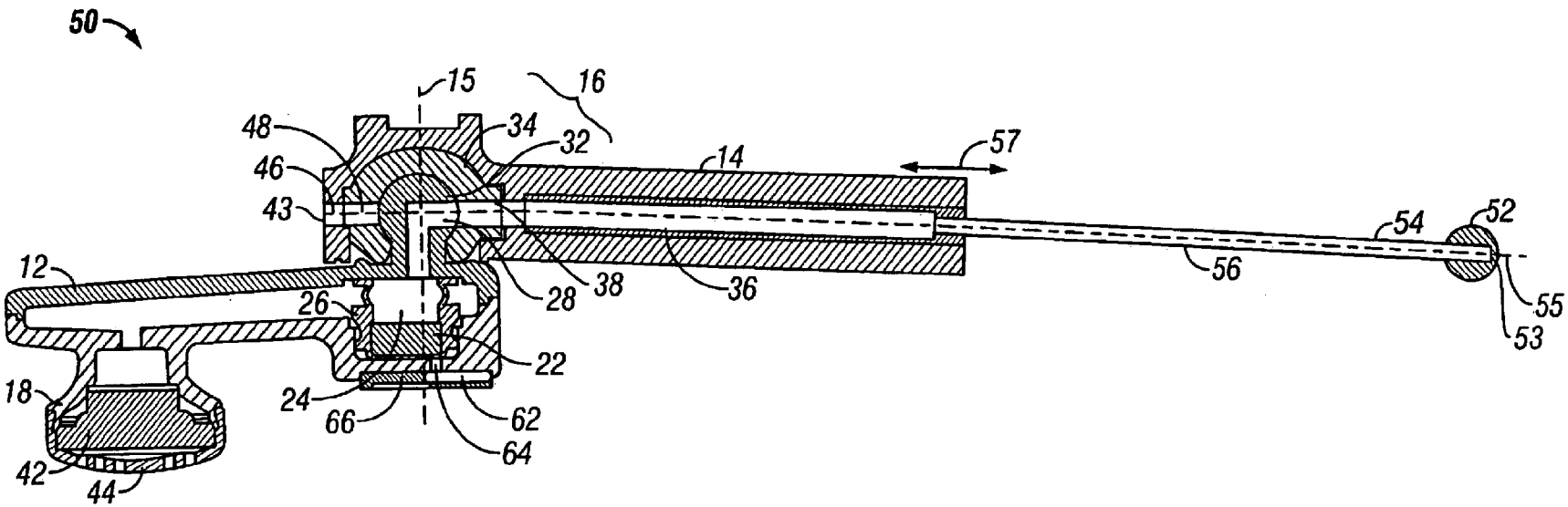
FIGS. 10(*a*) and (*b*) are cross-sectional views of the headset shown in FIG. 8 in the fully-extended mode of operation with the sliding inner boom in the fully extended position, and in the compact mode of operation, respectively.
Figure 10B:
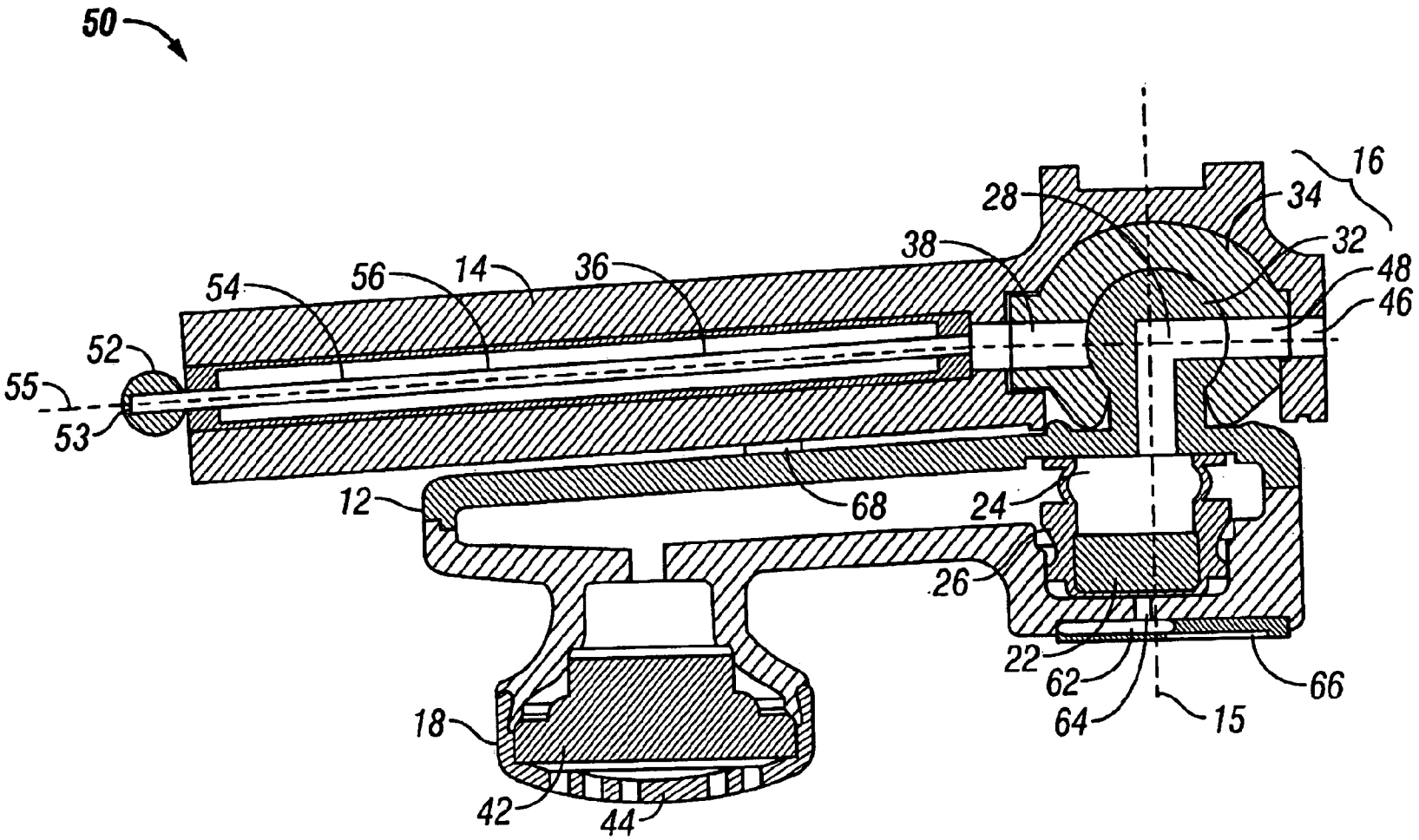

Communications headset 50 is further illustrated in FIG. 10(*a*), which presents a cross-sectional view of the headset 50 with boom 14 and secondary boom 54 disposed in the same positions as shown in FIG. 8, corresponding to the double-extended mode of operation. Most details of headset 50 are identical to those depicted in FIG. 3(*a*) for headset 10. For example, shown near one end of the main body 12 is the earpiece 18, encapsulating its various acoustic and electrical components 42, 44 for receiving audio transmission from the remote user, and shown near the opposite end of main body 12 is the microphone 22 with the associated cavity 24 and boot 26. Also analogous to headset 10, headset 50 includes an acoustic valve 16 comprising a pivot ball 32 and a pivot socket 34. In addition to allowing a pivoting mechanism for selecting between the compact and extended-boom operating modes, the headset 50 also offers choices regarding the sliding position of the secondary boom 54. The additional operational arrangements of headset 50 are enabled by disposing the secondary boom 54 at various sliding positions along the axis 55, as indicated in FIG. 10(*a*) by arrow 57. Another detail of headset 50 depicted in FIG. 10(*a*) that differ significantly from details included in FIG. 3(*a*) relates to the use of acoustic cavities to control the microphone's sensitivity towards acoustic signals received. Such use will be discussed below in connection with both FIGS. 10(*a*) and (*b*).

As mentioned above, the mode of operation illustrated in FIG. 10(*a*) may be referred to as a double-extended operating mode, which involves an unfolded boom 14 and an extended secondary boom 54. The double-extended mode of operation entails the slidable and rotatable alignment of sound tubes 36 and 56, link tube 38 in pivot socket 34, and the bent link tube 28 in pivot ball 32 to form the acoustic channel for sound wave conveyance. The resulting acoustic channel couples the microphone 22 to the acoustic sensing point 53 at the distal end of the secondary boom 54. When the secondary boom 54 is fully extended, as is the case in FIG. 10(*a*), the headset 50 is operating in the fully-extended mode. In this mode, the acoustic sensing point located at opening 53 is placed as far away from the main body 12 of headset 50 as possible, which usually means that it is disposed as close to the desired acoustic source as possible in typical usage of the headset 50.

FIG. 10(*b*) shows another cross-sectional view of the communications headset 50, this time with the secondary boom 54 completely retracted and the boom 14 rotated over the top of the main body 12. The headset 50 is thus operating in the compact mode. Most elements illustrated in FIG. 10(*b*) are shown in FIG. 10(*a*) and discussed above. Note, however, that the acoustic cavity 62 has been repositioned so that it is now acoustically coupled with acoustic cavity 64 and the microphone 22. This change results in a change in the microphone sensitivity, as discussed below.

According to another aspect of this invention, the movable boom also enables the implementation of control mechanisms in the communications headset 10 or 50 based on the different positioning of the boom 14 to compensate for different distances between the acoustic sensing point and the desired sound source. These control mechanisms may include adjustment in either the sensitivity of the microphone, the amplification gain of the transmit signals, or the amount of transmission loss when the sound is conducted from the acoustic sensing point to the microphone. Accordingly, the control mechanisms may be implemented as either mechanical, electrical or acoustic means.

In one embodiment in accordance with this aspect of the present invention, the sensitivity of the microphone can be adjusted in response to the boom's position. This adjustment can be either mechanical or electrical. A mechanical control mechanism is illustrated in FIGS. 10(*a*) and (*b*) for headset 50, and those skilled in the art will readily recognize that the same mechanism can also be used for headset 10. An alternative mechanism is also shown in FIGS. 4(*a*) and (*b*). The mechanical control mechanism is made possible with the use of a specific type of microphone that is recognized in the trade as noise canceling, close talking, or bi-directional microphone. This type of microphone is often used in communications headsets for its proximity effect. Proximity effect denotes the fact that this type of microphone is more sensitive to a nearby sound source than it is to distant sources producing the same sound level at the microphone location. As it is readily recognized by those skilled in the art, this type of microphone is provided with sound ports on both sides of the microphone diaphragm, rather than only on one side, as in omni-directional microphones, which are sealed on one side. Also readily recognizable by those skilled in the art, a condenser microphone's sensitivity is a function of the effective stiffness of its diaphragm, and the greater the effective stiffness of the diaphragm is, the less sensitive the microphone will be. Therefore, according to one embodiment of the present invention, it is possible to use one side of a bi-directional electret condenser microphone to pick up sound, and control microphone sensitivity by varying the volume of an acoustic cavity adjoining the opposite side of the microphone. It should be noted, however, that when a bi-directional microphone is used in this fashion, its effective sound pickup characteristic will be omni-directional, and the microphone will not exhibit the proximity effect. Those skilled in the art will recognize that unidirectional or cardioid, but not omni-directional, microphones may also be used in this embodiment of the invention. Those skilled in the art will also recognize that for this embodiment of the invention, capacitive microphone types other than the electret condenser type mentioned above can be used. On the other hand, an ordinary dynamic microphone, which pass-band, mechanical impedance is controlled by the moving mass rather than diaphragm stiffness, cannot be used in this embodiment.

Referring back to FIG. 10(*a*), there is illustrated that in addition to acoustic cavity 24 above the electret condenser microphone 22, two additional acoustic cavities 62 and 64 are included below the bi-directional microphone 22. In the double-extended mode of operation of headset 50 illustrated in FIG. 10(*a*), the cavity 62 is not connected to the other cavities 24 and 64. Also shown is that the microphone 22 adjoins the large cavity 24 above it but is exposed only to the small cavity 64 on the other side. Hence, compared to the case when the boom is folded, the microphone 22 is relatively insensitive to the sound input, meaning that for a given amplitude of sound pressure in the large cavity 24, the resulting transmit signals are at a lower amplitude level. In this position, headset 50 operates in the double-extended mode, and the acoustic sensing point is located at opening 53, which is extended close to the desired acoustic source. Accordingly, the microphone can operate with less sensitivity and still generate transmit signals with adequate amplitude for communications.

On the other hand, if the boom 14 is repositioned such that the acoustic cavity 62 becomes acoustically coupled with acoustic cavity 64, as is the case illustrated in FIG. 10(*b*), the total volume of acoustic cavities to which the microphone is exposed underneath it will be larger. Hence, the microphone is more sensitive to sound input when the boom 14 is disposed as shown in FIG. 10(*b*). This increase in microphone sensitivity compensates for the increased distance of the acoustic sensing point from the desired acoustic source when the acoustic sensing point is located at opening 43 in this compact operating mode.

In the described embodiment, the change in the position of the cavity 62 with respect to microphone 22 and cavity 64 is facilitated by a rotation clip assembly 66. As shown in FIGS. 10(*a*) and (*b*), the clip assembly 66 is adapted to rotate the acoustic cavity 62 around axis 15 in sync with boom 14. As illustrated in FIGS. 10(*a*) and (*b*), the acoustic cavity 62 is enclosed by the main body 12 on the top and the clip assembly 66 on all other sides. It is therefore designed to rotate relative to the main body 12 about axis 15 when the clip assembly 66 rotates about the same axis 15. It will, however, be readily apparent to one skilled in the art that the cavity 62 can be located in a variety of different positions within headset 50, and that many different mechanisms may be utilized to align or re-align the acoustic cavities among each other and with the microphone 22.

An alternative mechanism is shown in FIGS. 4(*a*) and (*b*). There is shown an alternative design of the acoustic valve, in which an electret condenser type bi-directional microphone 22 is sandwiched between two acoustic cavities 24*a* and 24*b*, each connected to a link tube 78, 88. As the cylindrical tube forming the valve shell turns with the boom 14, the link tubes 78, 88 are selectively coupled with a sound tube 36, 46 to form an active acoustic channel. The acoustic cavity not coupled becomes a sealed cavity, of which the volume then affects the sensitivity of the microphone as discussed above. Hence, when the headset 20 operates in the extended-boom mode depicted in FIG. 4(*a*), the acoustic sensing point is disposed close to the desired acoustic source thus receiving a high level of sound input, but the small cavity 24*b* acoustically coupled to the microphone 22 reduces the microphone sensitivity. Conversely, when headset 20 operates in the compact mode depicted in FIG. 4(*b*), the acoustic sensing point is disposed further away to the desired acoustic source thus receiving a lower level of sound input. However, the microphone 22 is now more sensitive because it is acoustically coupled to a larger cavity 24*a*.

Another input sound level compensation mechanism uses electrical elements to control the sensitivity of the microphone 22. In one embodiment of the present invention, the microphone 22 is of an electret condenser type and the boom 14 is electromechanically coupled to a control circuit that changes the supply voltage associated with the microphone 22, thus changing the microphone sensitivity. Alternatively, the adjustment circuit can alter the bias resistance to change the sensitivity. In the described embodiment that implements such a control circuit, a boom-actuated switch 68 (shown in FIGS. 3(*a*) and (*b*)) is located on the main body 12 such that it will be mechanically engaged when the boom 14 is in certain positions, for example, when it is rotated on top of the main body 12. Once engaged, the switch activates the control circuit that modifies the supply voltage (or bias resistance) associated with the microphone 22. Note that, although the switch 68 is illustrated only with headset 10 and shown in FIG. 3(*a*), the same switch mechanism is equally applicable to headsets 50, 100 and 110, provided that a switch is included in an appropriate location, probably on the main body.

Yet another way to compensate for the change in the microphone's receptivity according to this aspect of the present invention is by means of a transmit controller circuit disposed in the body 12 of the headset 10 that can modify the signal gain applied to transmitted electrical signals. Typically when the microphone 22 receives acoustic signals, it converts them into electrical signals, which are amplified and become the transmit signals. The amplification of signals as measured by the ratio between the levels of the transmit signals and the microphone signals is known as the transmit gain. One way of implementing the transmit controller is to install a boom-activated switch 68 on the main body 12 of the headset 10, as described above. Thus, when the ratio of sound level at the acoustic sensing point to sound level at the desired sound source is high due to the acoustic sensing point being disposed close to the desired acoustic source (as in the extended-boom mode of operation illustrated in FIG. 3(*a*)), the switch is deactivated and a small transmit gain is applied.

On the other hand, in the compact mode of operation as illustrated in FIG. 3(*b*), when boom 14 is rotated on top of main body 12, the switch will be engaged, which will, in turn, activate the transmit controller to increase the transmit gain to compensate for the acoustic sensing point being disposed relatively far away from the desired acoustic source. Again, although the switch 68 is illustrated only with headset 10 and shown in FIGS. 3(*a*) and (*b*), the same switch mechanism and transmit controller is equally applicable to headsets 20, 50, 100, and 110.

Still another implementation of input sound level compensation involves the use of acoustic attenuation to modify the transmission loss in the acoustic channels, such as that in the sound tube 36 linking opening 13 on the boom 14 to microphone 22 in the extended-boom mode of operation as illustrated in FIGS. 3 and 10 with respect to headsets 10 and 50, by way of example. The modification is accomplished, for instance, by disposing acoustic energy attenuator elements inside or along the wall of the long sound tube 36. Wadding material such as wool yarn, feather, or the like-can be used for this purpose. Hence, when the headset 10 or 50 is operating in the extended-boom (as in FIG. 3(*a*)) or double-extended mode (as in 10(*a*)), the active acoustic channel comprises the long sound tube 36, which includes the acoustic energy attenuator elements that induce higher transmission loss. For a given sound level at the source, the higher transmission loss is, however, compensated by the higher sound level at the acoustic sensing point which is closer to the source. In contrast, when the headset 10, 50 is operating in the compact mode, the sound level at the acoustic sensing point is lower, but the transmission loss is also lower, the short sound tube 46 being free of acoustic energy attenuator element. Alternatively, the inner diameter of the tube 36 can be made sufficiently small or be subdivided into a sufficiently large number of parallel small cross-sectioned tubes to induce acoustic resistance. The result is the same as that discussed above, namely, that sensitivity to the desired sound source remains substantially constant, because higher transmission loss is matched with greater proximity to the source, and vice versa.

When a secondary boom is included in the communications headset, such as headset 50 depicted in FIG. 10, the inside bore of boom 14 may be lined with sound absorbing material such as felt or cork, and the secondary boom can be made of materials with little or no transmission loss, such as stainless steel. Thus, the more the secondary boom is extended towards the desired acoustic source, the more sound absorbing material is exposed, and the more transmission loss is built into the active acoustic channel. When the secondary boom is partly extended, the active acoustic channel comprises sound tube 56, part of sound tube 36, link tube 38 and bent link tube 28.

An alternative way to induce transmission loss in the long sound tube 36 is by giving it a reverse exponential horn shaped or similarly tapered waveguide, in which the cross section increases from a small area at the distal end of the boom 14 or secondary boom 54 to a larger area near the microphone 22. Conversely, provided at least two sound tubes are selectively used, the short sound tube 46 may be given an exponential horn shape to increase the acoustic conductivity. Thus, when the headset 10, 50 operates in the extended-boom or double-extended mode, the acoustic sensing point is disposed close to the desired acoustic source, but the impedance mismatch between the acoustic sensing point and the microphone is also greater. On the other hand, when the headset 10, 50 operates in the compact mode, the greater drop of acoustic pressure between the desired acoustic source and the acoustic sensing point can be compensated by greater impedance match between the acoustic sensing point and the microphone.

Although the invention has been described in considerable detail with reference to certain embodiments, other embodiments are possible. As will be appreciated by those of skill in the art, the invention may be embodied in other specific forms without departing from the essential characteristics thereof Those skilled in the art will recognize that there are other means of implementing a communications headset that operates in multiple modes and arrangements with an acoustic valve enabling the selection of different acoustic sensing points in different modes. For example, the acoustic valve may be controlled by a secondary boom that pivots about the primary boom. Also, the valve may take a variety of different shapes, sizes and mechanical arrangements not described. Those skilled in the art will also recognize alternative mechanisms that enable the headset to maintain a consistent level of sound transmission to accommodate different modes of operation. Additionally, it will also be apparent to a person skilled in the art that the boom controlled acoustic valve mechanism may be used in applications other than communication headsets. These applications may be found, for example, in mobile phones, sound recorders, and video cameras. Accordingly, the present invention is intended to embrace all such alternatives, modifications and variations that fall within the spirit and scope of the appended claims and equivalents.

What is claimed is:

1. An apparatus for receiving acoustic signals from a desired acoustic source and generating transmit signals, the apparatus comprising:

a microphone;

an acoustic valve, coupled to the microphone; and a boom, movably coupled to the acoustic valve and adapted to be positioned in at least a first position or a second position, and further having at least a first opening and a second opening, the acoustic valve acoustically coupling the first opening to the microphone when the boom is in the first position and acoustically coupling the second opening to the microphone when the boom is in the second position.

2. The apparatus of claim 1, wherein:

the microphone is adapted to receive acoustic signals through an acoustic sensing point, the acoustic sensing point being located at the first opening of the boom when the boom is in the first position and at the second opening of the boom when the boom is in the second position.

3. The apparatus of claim 1, wherein:

the first opening is closer to the desired acoustic source than the second opening when the boom is in the first position and the second opening is closer to the desired acoustic source than the first opening when the boom is in the second position.

4. The apparatus of claim 1, wherein the acoustic valve comprises:

a valve core; and a valve cap, rotatably coupled to the valve core about a valve axis.

5. The apparatus of claim 4, wherein:

the valve core is a pivot ball; and the valve cap is a pivot socket.

6. The apparatus of claim 4, wherein:

the valve core is a cylindrical hub; and the valve cap is a cylindrical cap.

7. The apparatus of claim 4, wherein:

the valve core encloses a link tube, acoustically coupled to the microphone at one end, and adapted to be acoustically coupled at an opposite end to the first opening when the boom is in the first position, and to the second opening when the boom is in the second position.

8. The apparatus of claim 4, wherein:

the valve core encloses at least a first link tube and a second link tube, the first link tube being acoustically coupled at one end to the microphone and at an opposite end to the first opening when the boom is in the first position, and the second link tube being acoustically coupled at one end to the microphone and at an opposite end to the second opening when the boom is in the second position.

9. The apparatus of claim 8, wherein:

the valve core further encloses the microphone; and the first and the second link tubes are on opposite sides of the microphone's diaphragm.

10. The apparatus of claim 1, wherein the boom pivots about the acoustic valve.

11. The apparatus of claim 1, further comprising:

a first acoustic channel, adapted to acoustically couple the first opening to the microphone when the boom is in the first position; and a second acoustic channel, adapted to acoustically couple the second opening to the microphone when the boom is in the second position.

12. The apparatus of claim 11, wherein the first acoustic channel comprises a first sound tube extending substantially axially in line with the boom from the acoustic valve to the first opening.

13. The apparatus of claim 1, wherein the first opening and the second opening are disposed on the boom on opposite sides of the acoustic valve.

14. The apparatus of claim 1, further comprising:

a secondary boom, slidably coupled to the boom and terminating in a third opening at its distal end, the secondary boom being adapted to adjust to at least a first sliding position relative to the boom, and further adapted to dispose the third opening closer to the desired acoustic source than the first opening of the boom when the boom is in the first position and the secondary boom is in the first sliding position, wherein the third opening is acoustically coupled to the microphone.

15. The apparatus of claim 1, wherein:

the microphone is adapted to be acoustically coupled with an acoustic sensing point located at a distal end of the boom via the first opening when the boom is in the first position and via the second opening when the boom is in the second position.

16. The apparatus of claim 1, wherein the microphone converts acoustic signals into electrical signals, the apparatus further comprising:

a transmit controller for adjusting a transmit gain applied to the electrical signals based on the boom's position.

17. The apparatus of claim 16, wherein the transmit controller further comprises:

a switch that causes the transmit controller to modify the transmit gain, the switch being activated when the boom is in at least one of the first and second positions.

18. The apparatus of claim 1, further comprising:

a control device for adjusting the microphone's sensitivity based on the boom's position.

19. The apparatus of claim 18, wherein:

the microphone is an electret condenser microphone; and the control device adjusts a supply voltage associated with the microphone.

20. The apparatus of claim 18, wherein:

the microphone is an electret condenser microphone; and the control device adjusts a bias resistance associated with the microphone.

21. The apparatus of claim 1, wherein:

the microphone is a directional microphone of capacitive type that generates transmit signals in proportion to pressure differences between a first side and a second side of the microphone's diaphragm; and the microphone's diaphragm is acoustically coupled on the first side to one of the first and second openings, and on the second side to at least one sealed cavity, of which volume the microphone's sensitivity to acoustic signals received on the first side of the diaphragm depends, the volume of the at least one sealed cavity being adjusted in response to position of the boom.

22. The apparatus of claim 1, wherein:

the microphone is a directional microphone of capacitive type that generates transmit signals in proportion to pressure differences between a first side and a second side of the microphone's diaphragm; and the microphone's diaphragm is acoustically coupled to the first opening on the first side and to a first set of one or more sealed cavities on the second side when the boom is in the first position, and acoustically coupled to the second opening on the second side and to a second set of one or more sealed cavities on the first side when the boom is in the second position, the microphone's sensitivity to acoustic signals on one side of the microphone being a function of volumes of sealed acoustic cavities to which the microphone's diaphragm is acoustically coupled on another side.

23. The apparatus of claim 1, further comprising:

a first acoustic channel acoustically coupling the microphone to the first opening when the boom is in the first position, and a second acoustic channel acoustically coupling the microphone to the second opening when the boom is in the second position, wherein the first acoustic channel has a first transmission loss and the second acoustic channel has a second transmission loss.

24. The apparatus of claim 23 wherein:

the first acoustic channel comprises a first sound tube with a first geometrical shape providing a first acoustic impedance coupling ratio to the microphone, and the second acoustic channel comprises a second sound tube with a second geometrical shape providing a second acoustic impedance coupling ratio to the microphone, the first and the second transmission losses being a function of the respective impedance coupling ratios.

25. The apparatus of claim 23 wherein:

the first acoustic channel comprises a first sound tube encased in a first material and the second acoustic channel comprises a second sound tube encased in a second material, the associated transmission losses being a function of the respective encasing materials of the first and second acoustic channels.

26. The apparatus of claim 1, wherein:

the first opening is located at a first distance from the desired acoustic source when the boom is in the first position and the second opening is located at a second distance from the desired acoustic source when the boom is in the second position, the first distance shorter than the second distance.

27. The apparatus of claim 26, wherein the microphone converts acoustic signals into electrical signals, the apparatus further comprising:

a transmit controller that applies a first transmit gain to the electrical signals in response to the boom being in the first position, and a second transmit gain to the electrical signals in response to the boom being in the second position, wherein the first transmit gain is smaller than the second transmit gain.

28. The apparatus of claim 26, further comprising:

a control device that provides the microphone with a first level of sensitivity in response to the boom being in the first position, and a second level of sensitivity in response to the boom being in the second position, wherein the first level of sensitivity is smaller than the second level of sensitivity.

29. The apparatus of claim 26, wherein:

the microphone is a directional microphone of capacitive type and is disposed adjacent to one or more acoustic cavities enclosed in the apparatus, the microphone's sensitivity to acoustic signals on one side of the microphone being a function of the volumes of all sealed acoustic cavities to which the microphone is acoustically coupled on an opposite side; and the microphone is acoustically coupled to a first set of one or more sealed acoustic cavities when the boom is in the first position and to a second set of one or more sealed acoustic cavities when the boom is in the second position, the first set of sealed acoustic cavities having smaller total volume than the second set of scaled acoustic cavities.

30. The apparatus of claim 26, further comprising:

a first acoustic channel acoustically coupling the microphone to the first opening and a second acoustic channel acoustically coupling the microphone to the second opening, wherein the first acoustic channel is associated with a first transmission loss and the second acoustic channel is associated with a second transmission loss, the first transmission loss being greater than the second transmission loss.

31. The apparatus of claim 30, wherein the first acoustic channel includes an acoustic energy attenuator element.

32. The apparatus of claim 30, wherein the first acoustic channel comprises a tapered sound tube, of which the cross sectional area increases with distance from the second opening.

33. The apparatus of claim 32, wherein the tapered sound tube is of a reversed exponential horn shape.

34. The apparatus of claim 30, wherein the second acoustic channel comprises an exponential horn shaped sound tube, the cross sectional area of which decreases with distance from the first opening.

35. The apparatus of claim 1, wherein the apparatus is a communications headset.

36. The apparatus of claim 1, wherein the apparatus is a mobile phone.

37. The apparatus of claim 1, wherein the apparatus is a sound recorder.

38. The apparatus of claim 1, wherein the apparatus is a video camera.

39. An apparatus for receiving acoustic signals from a desired acoustic source and generating transmit signals, the apparatus comprising:

a main body enclosing a microphone and having at least a first opening; and a boom, movably coupled to the main body and adapted to be positioned in at least a first position or a second position, and further having at least a second opening, wherein the microphone is adapted to be acoustically coupled with the first opening when the boom is in the first position and acoustically coupled with the second opening when the boom is in the second position.

40. The apparatus of claim 39, wherein:

the first opening is closer to the desired acoustic source than the second opening when the boom is in the first position and the second opening is closer to the desired acoustic source than the first opening when the boom is in the second position.

41. An apparatus for receiving acoustic signals from a desired acoustic source and generating transmit signals, the apparatus comprising:

a main body enclosing a microphone;

a boom, movably coupled to the main body and adapted to be positioned in at least a first position or a second position;

a first acoustic channel, adapted to acoustically couple the microphone to a first opening for receiving acoustic signals when the boom is in the first position; and a second acoustic channel, adapted to acoustically couple the microphone to a second opening for receiving acoustic signals when the boom is in the second position.

42. The apparatus of claim 41, wherein:

the first opening is as least as close to the desired acoustic source as is the second opening when the boom is in the first position and the second opening is at least as close to the desired acoustic source as is the first opening when the boom is in the second position.

43. The apparatus of claim 41, further comprising:

an acoustic valve, coupled to the microphone and adapted to acoustically couple the microphone to the first opening via the first acoustic channel when the boom is in the first position, and acoustically couple the microphone to the second opening via the second acoustic channel when the boom is in the second position.

44. The apparatus of claim 43, wherein the acoustic valve comprises:

a pivoting ball; and a pivoting socket, rotatably coupled to the valve core about a valve axis.

45. The apparatus of claim 43, wherein the acoustic valve comprises:

a cylindrical hub; and a cylindrical cap, rotatably coupled to the valve core about a valve axis.

46. The apparatus of claim 43 wherein the first opening and the second opening are disposed on the boom on opposite sides of the acoustic valve.

47. The apparatus of claim 43 wherein the first acoustic channel is extendable.

48. The apparatus of claim 41, wherein the second acoustic channel forms a portion of the first acoustic channel when the boom is in the first position.

49. The apparatus of claim 48, wherein the second acoustic channel is fixed relative to the microphone when the boom is in both the first and the second positions.

50. The apparatus of claim 48, wherein the first opening coincides with the second opening.

* * * * *